US011078818B2

(12) United States Patent
Son

(10) Patent No.: US 11,078,818 B2
(45) Date of Patent: Aug. 3, 2021

(54) SYSTEM FOR REDUCING PARTICULATE MATTER IN EXHAUST GAS

(71) Applicant: THE PRIME SOLUTION L.L.C., Seoul (KR)

(72) Inventor: Chang Soo Son, Seoul (KR)

(73) Assignee: THE PRIME SOLUTION L.L.C., Seoul (KR)

( * ) Notice: Subject to any disclaimer, the term of this patent is extended or adjusted under 35 U.S.C. 154(b) by 0 days.

(21) Appl. No.: 16/640,310

(22) PCT Filed: Aug. 22, 2017

(86) PCT No.: PCT/KR2017/009155
§ 371 (c)(1),
(2) Date: Feb. 19, 2020

(87) PCT Pub. No.: WO2019/039623
PCT Pub. Date: Feb. 28, 2019

(65) Prior Publication Data

US 2020/0256229 A1 Aug. 13, 2020

(51) Int. Cl.
*F01N 3/01* (2006.01)
*F01N 3/027* (2006.01)

(52) U.S. Cl.
CPC ..... *F01N 3/01* (2013.01); *F01N 3/027* (2013.01); *F01N 2240/28* (2013.01)

(58) Field of Classification Search
CPC ..... F01N 3/0892; F01N 3/01; F01N 2240/04; F01N 2240/05; F01N 2240/12; F01N 2240/16; F01N 2240/28
USPC ..... 60/275, 286, 303, 295, 311
See application file for complete search history.

(56) References Cited

U.S. PATENT DOCUMENTS

| | | | |
|---|---|---|---|
| 5,263,317 | A | 11/1993 | Watanabe et al. |
| 6,482,368 | B2 | 11/2002 | Hemingway et al. |
| 6,852,200 | B2 | 2/2005 | Labarge et al. |
| 2004/0185396 | A1 | 9/2004 | Rosocha et al. |
| 2005/0019714 | A1 | 1/2005 | Platts et al. |
| 2007/0045101 | A1 | 3/2007 | Ogut et al. |

(Continued)

FOREIGN PATENT DOCUMENTS

| | | | |
|---|---|---|---|
| JP | 2005-240634 | A | 9/2005 |
| JP | 2011-064161 | A | 3/2011 |

(Continued)

OTHER PUBLICATIONS

International Search Report from corresponding PCT Application No. PCT/KR2017/009155, dated Jul. 5, 2018.

*Primary Examiner* — Mark A Laurenzi
*Assistant Examiner* — Mickey H France
(74) *Attorney, Agent, or Firm* — Harness, Dickey & Pierce, P.L.C.

(57) ABSTRACT

A disclosed system for reducing particulate matter in an exhaust gas includes: a first conductor provided in the form of a tubular body through which a gas stream flows, and to which a ground power supply is connected; a second conductor disposed within the first conductor and having an emitter which comes into contact with the gas stream and generates non-thermal plasma (NTP); and an insulator for electrically separating the second conductor from the first conductor, in which a predetermined level of direct current voltage is continuously applied to the second conductor.

7 Claims, 4 Drawing Sheets

(56) References Cited

U.S. PATENT DOCUMENTS

| | | | | |
|---|---|---|---|---|
| 2008/0314734 | A1 | 12/2008 | Kim et al. | |
| 2009/0241775 | A1* | 10/2009 | Ogut | F01N 3/38 95/59 |
| 2016/0040567 | A1* | 2/2016 | Vorsmann | B03C 3/49 60/274 |
| 2016/0341086 | A1* | 11/2016 | Sugimoto | F01N 3/01 |

FOREIGN PATENT DOCUMENTS

| | | | |
|---|---|---|---|
| KR | 10-2001-0001008 | A | 1/2001 |
| KR | 10-2011-0009659 | A | 1/2011 |

* cited by examiner

SYSTEM FOR REDUCING PARTICULATE MATTER IN EXHAUST GAS

CROSS-REFERENCE TO RELATED APPLICATIONS

This application is a national phase application of PCT International Application No. PCT/KR2017/009155, filed on 22 Aug. 2017. The entire disclosure of the application identified in this paragraph is incorporated herein by reference.

FIELD

The present disclosure relates to a system for reducing particulate matter in exhaust gas, and particularly, to a system for reducing particulate matter in exhaust gas, which uses non-thermal plasma (NTP) to remove particulate matters (PMs) contained in exhaust gas generated from a vehicle, a semiconductor process, or the like, thereby reducing the amount of particulate matters to be released into the atmosphere.

BACKGROUND

This section provides background information related to the present disclosure which is not necessarily prior art.

Internal combustion engines, which are supplied with fuel such as gasoline or diesel, are major causes of environmental pollution that affects the entire environment as well as human health and life.

Carbon monoxide (CO), nitrogen oxide (NOx), sulfur dioxide ($SO_2$), non-methane hydrocarbon (NMHC), and particulate matters (PMs) are produced as a result of incomplete combustion in the gasoline or diesel engines.

Despite regulations that have been in force for decades, these pollutants continue to be released into the environment in excess of regulatory standards even in the countries with strict emission regulations.

Moreover, technologies that meet these emission standards are difficult to obtain even at present.

One technique, which offers great potential for reducing the emission of contaminants, especially particulate matters from the combustion engines, is to use non-thermal plasma (NTP) to improve combustion efficiency and reduce the emission of exhaust gas.

Studies related to combustion efficiency report that the non-thermal plasma (NTP) can be used to more easily and perfectly divide large organic fuel molecules into smaller molecules. Examples of such studies are disclosed in US Patent Application Publication Nos. 2004/0185396, 2005/0019714, and 2008/0314734.

On the other hand, other studies report that the non-thermal plasma (NTP) can be used to directly reduce the emission of exhaust gas.

For example, the majority of studies related to the non-thermal plasma (NTP) have been conducted on systems configured to reduce the emission of NOX, and examples of these studies are disclosed in U.S. Pat. Nos. 6,482,368 and 6,852,200.

On the other hand, other systems reduce particulate matters (PMs) by using the non-thermal plasma (NTP). Examples of these systems are disclosed in U.S. Pat. No. 5,263,317 and U.S. Patent Application Publication No. 2007/0045101.

Despite the advantages of these non-thermal plasma (NTP)-based systems that reduce the emission of exhaust gas, the use of technologies associated with the non-thermal plasma (NTP) has been complicated due to the effects of pollutants and products degraded from exhaust gas on such systems.

In particular, because the particulate matters (PMs) coat the elements involved in producing the non-thermal plasma (NTP), the efficiency of the non-thermal plasma (NTP) system may deteriorate or the non-thermal plasma system may be damaged.

When the non-thermal plasma NTP is generated electrically, the particulate matters (PMs) are accumulated, and redirection of current occurs by the conductive path created by the accumulation of such conductors. The redirection of current causes a loss of power, reduces the amount of non-thermal plasma (NTP) to be generated, and reduces the efficiency in removing the particulate matters.

In addition, an amount of power is consumed to reduce the particulate matters (PMs). The current non-thermal plasma (NTP) system can reduce the particulate matters (PMs) only by 25% by consuming hundreds of watts of power. Accordingly, there is a need for developing a non-thermal plasma (NTP) system that significantly increases a rate of reduction of particulate matter (PM) with respect to power consumption.

SUMMARY

Technical Problem

An object of the present disclosure is to provide a non-thermal plasma (NTP)-based system for reducing particulate matter in exhaust gas, which reduces the amount of particulate matters (PMs) in a stream of gas such as exhaust gas.

Another object of the present disclosure is to provide a non-thermal plasma (NTP)-based system for reducing particulate matter in exhaust gas, which inhibits the accumulation of particulate matters and the occurrence of arcing that cause a reduction in the occurrence of non-thermal plasma (NTP).

Technical Solution

This section provides a general summary of the disclosure and is not a comprehensive disclosure of its full scope or all of its features.

In order to achieve the above-mentioned objects, a system for reducing particulate matter in exhaust gas according to one aspect of the present disclosure includes: a first conductor provided in the form of a tubular body through which a gas stream flows, and to which a ground power supply is connected; a second conductor disposed within the first conductor and having an emitter which comes into contact with the gas stream and generates non-thermal plasma (NTP); and an insulator for electrically separating the second conductor from the first conductor, in which a predetermined level of direct current voltage is continuously applied to the second conductor.

In the system for reducing particulate matter in exhaust gas according to one aspect of the present disclosure, the second conductor may include: a vertical rod disposed in a radial direction of the first conductor; a horizontal rod extending from an end of the vertical rod in a direction parallel to a flow direction of the gas stream; and an emitter provided at an end of the horizontal rod and having multiple protrusions formed on an outer surface of the emitter and each having a cutting edge.

In the system for reducing particulate matter in exhaust gas according to one aspect of the present disclosure, the insulator may be made of an electrically insulating material and provided to surround the vertical rod, one end of the insulator may be disposed inside the first conductor, the other end of the insulator may be disposed outside the first conductor to electrically separate the second conductor and the first conductor, and a coupling groove, to which the horizontal rod is fitted, is provided at the end of the insulator, which is disposed in the first conductor, so that a coupled state between the first conductor and the second conductor remains constantly.

In the system for reducing particulate matter in exhaust gas according to one aspect of the present disclosure, the system may include: an anti-arcing member provided to cover one of the two ends of the insulator which is disposed inside the first conductor, in which the anti-arcing member is joined to the horizontal rod and made of a material having resistance to corrosion (erosion) caused by electric discharge.

In the system for reducing particulate matter in exhaust gas according to one aspect of the present disclosure, the emitter may be positioned at a center inside the first conductor, and the horizontal rod may extend in a direction from the vertical rod toward an upstream of the gas stream.

In the system for reducing particulate matter in exhaust gas according to one aspect of the present disclosure, the insulator may be shaped such that a horizontal cross-sectional area is decreased in the first conductor in a direction from a wall surface of the first conductor toward the horizontal rod.

In the system for reducing particulate matter in exhaust gas according to one aspect of the present disclosure, negative power may be applied to the second conductor.

In the system for reducing particulate matter in exhaust gas according to one aspect of the present disclosure, direct current voltage applied to the second conductor is −30 kV to −80 kV.

In the system for reducing particulate matter in exhaust gas according to one aspect of the present disclosure, the multiple second conductors may be disposed in a longitudinal direction of the first conductor, each electrically insulated from the first conductor, and each have an emitter configured to produce non-thermal plasma (NTP).

Advantageous Effects

According to the present disclosure, since a predetermined level of direct current is continuously applied to the second conductor, it is possible to prevent particulate matters (PMs) from being incompletely removed or degraded due to overshooting of power, and to prevent particulate matters (PMs) or products degraded from the particulate matters from being accumulated on a surface of the insulator.

Therefore, it is possible to prevent a deterioration in efficiency of the system for reducing particulate matter in exhaust gas.

According to the present disclosure, the anti-arcing member may prevent the occurrence of arcing caused by particulate matters (PMs) or products degraded from the particulate matters which are accumulated on the surface of the insulator.

Therefore, it is possible to prevent a deterioration in efficiency of the system for reducing particulate matter in exhaust gas.

According to the present disclosure, the anti-arcing member and the coupling groove formed at the end of the insulator may improve the convenience in assembling the second conductor and the insulator, and the second conductor may be disposed at the central portion of the first conductor so as to be in parallel with a gas stream without a separate operation.

DETAILED DESCRIPTION

Hereinafter, an exemplary embodiment of a system for reducing particulate matter in exhaust gas according to the present disclosure will be described in detail with reference to the drawings.

However, it should be noted that the spirit of the present disclosure is not limited by the following exemplary embodiment, the following exemplary embodiment may be easily substituted with or changed to various exemplary embodiments by those skilled in the art without departing from the technical spirit of the present disclosure, and the various exemplary embodiments also belong to the technical spirit of the present disclosure.

In addition, the terms used herein are selected for convenience of description and should be appropriately interpreted as a meaning that conforms to the technical spirit of the present disclosure without being limited to a dictionary meaning when recognizing the technical contents of the present disclosure.

Figure 1:
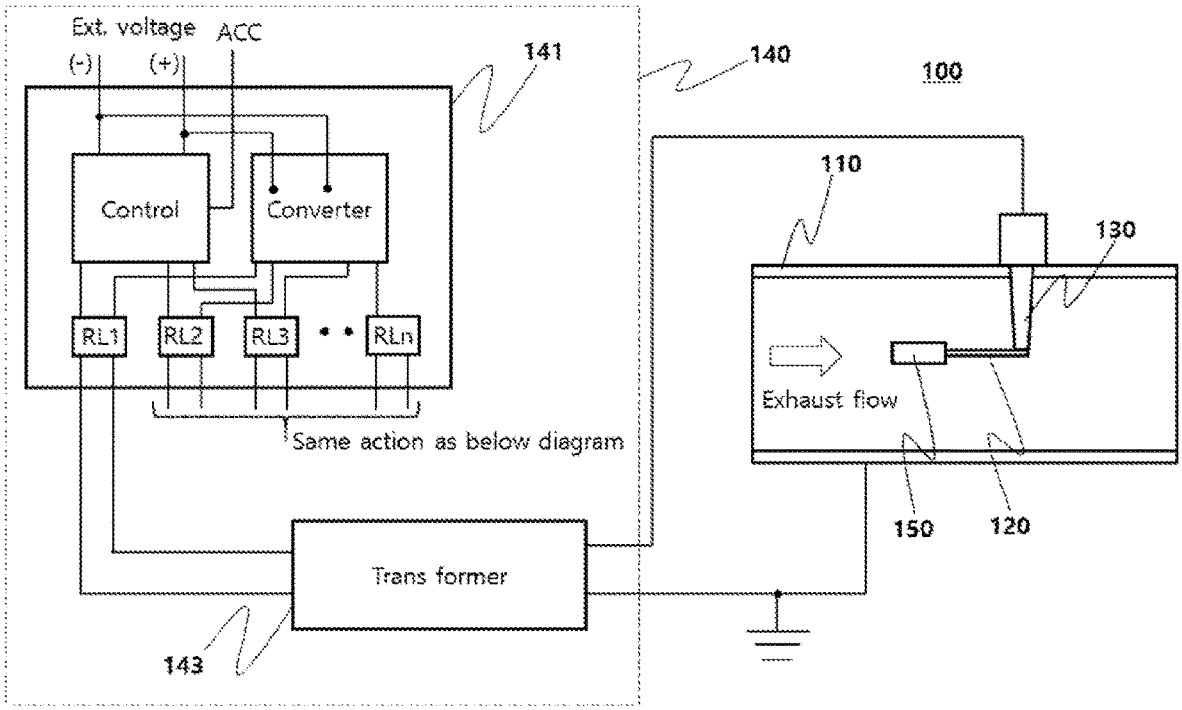
FIG. 1 is a view illustrating one exemplary embodiment of a system for reducing particulate matter in exhaust gas according to the present disclosure.
Figure 2:
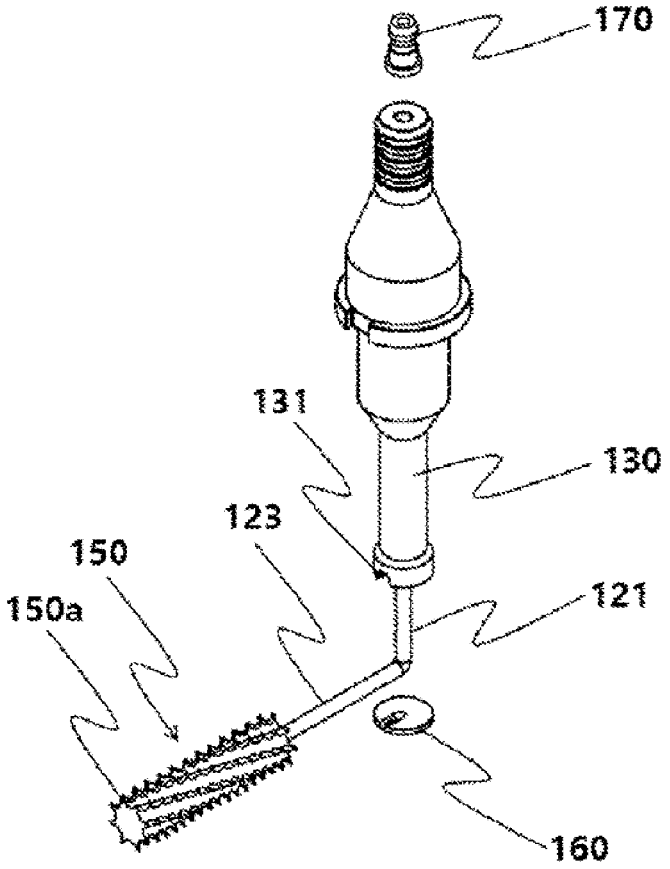
FIG. 2 and FIG. 3 are views illustrating an example of a second conductor in FIG. 1.
Figure 3:
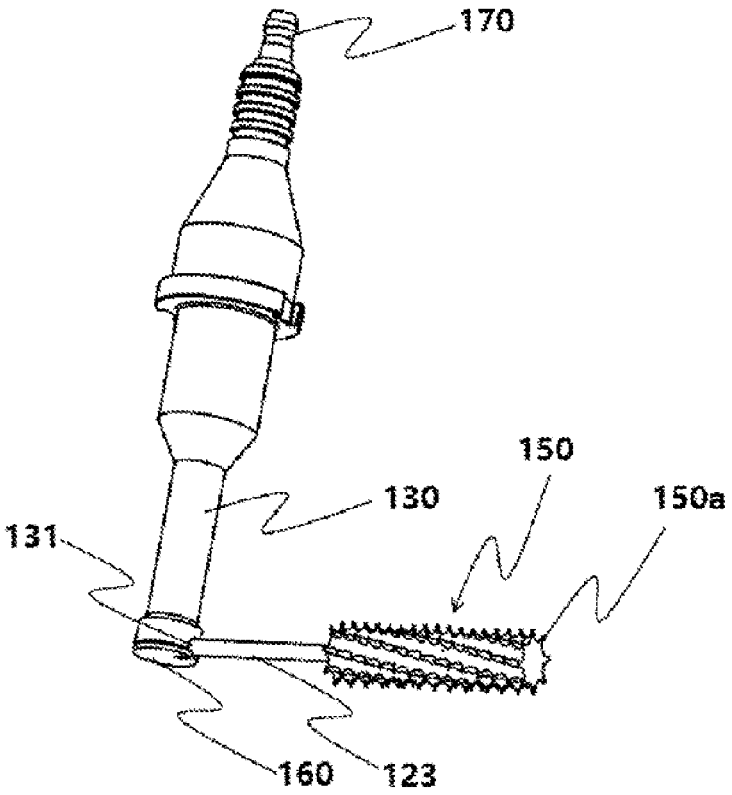

FIG. 1 is a view illustrating one exemplary embodiment of a system for reducing particulate matter in exhaust gas according to the present disclosure, and FIGS. 2 and 3 are views illustrating an example of a second conductor in FIG. 1.

Referring to FIGS. 1 to 2, a system 100 for reducing particulate matter in exhaust gas according to the present exemplary embodiment includes first and second conductors 110 and 120, an insulator 130, and a voltage applying unit 140.

The first conductor 110 is provided in the form of a tubular body through which a gas stream flows.

In addition, the first conductor 110 is connected to a ground power supply and made of a material having electrical conductivity.

The first conductor 110 may adopt an exhaust gas pipe used for a vehicle or a semiconductor process as it is, or a separate pipe is provided and used by being in communication with the exhaust gas pipe.

The second conductor 120 is disposed in the first conductor 110 and has an emitter 150 that comes into contact with the gas stream and produces non-thermal plasma (NTP).

In order to produce the non-thermal plasma (NTP), a voltage, which is different by a predetermined voltage value from a voltage to be applied to the first conductor 110, is applied to the second conductor 120.

Here, a predetermined level of direct current voltage needs to be continuously applied to the second conductor 120. Meanwhile, in the case of exhaust gas from a vehicle, a direct current voltage of −30 kV to −80 kV may be continuously applied.

Meanwhile, in order to produce the non-thermal plasma (NTP) based on the voltage difference between the first and second conductors 110 and 120, the insulator 130 is provided to electrically separate the second conductor 120 from the first conductor 110.

The insulator 130 is made of an electrically insulating material, and an example of the electrically insulating material may be ceramic. With surface roughness, it is possible to prevent particulate matters (PMs) or products degraded from the particulate matters from being accumulated on a surface of the insulator.

Meanwhile, in a case in which the insulator is made of a ceramic material having a dielectric capacity, it is possible to remove the particulate matters (PMs) or the products degraded from the particulate matters by oxidizing the particulate matters (PMs) or the products degraded from the particulate matters on the surface of the insulator. In this case, in order to perform the oxidation, it is possible to adjust a thickness of the insulator 130 so that the insulator 130 is relatively thin.

Meanwhile, in the present exemplary embodiment, the voltage applying unit 140 is configured to continuously apply a predetermined level of direct current voltage to the second conductor 120.

The voltage applying unit 140 includes: a system control unit 141 configured to control the connection of power between the system 100 for reducing particulate matter in exhaust gas according to the present exemplary embodiment and an apparatus in which the system 100 is installed; and a transformer 143 configured to convert a voltage, applied from a power source of the apparatus, into a voltage required for the system 100 for reducing particulate matter in exhaust gas according to the present exemplary embodiment.

Specifically, in the case of a vehicle as an example, the system control unit 141 has a control function of turning on or off the system based on a driving state of the vehicle and monitoring a state of a high-voltage part. When the high-voltage part is abnormal, the system control unit 141 may display the abnormal state by using a flickering LED. In this case, at RL, the system control unit 141 cuts off the supply of power to the transformer 143 in order to prevent the occurrence of other dangerous situations.

Meanwhile, a separate device is used to allow a user display to display a system operating situation by turning on the LED when the system operates normally or flickering the LED when the system operates abnormally.

The transformer 143 is a device configured to convert a low voltage into a high voltage and uses a multi-stage rectification method to generate a stable and high voltage with low ripple, thereby minimizing arcing that reduces system efficiency. Therefore, the transformer 143 allows the non-thermal plasma for removing particulate matters to always remain constant.

Meanwhile, in the present exemplary embodiment, the second conductor 120 includes a vertical rod 121, a horizontal rod 123, and the emitter 150.

The vertical rod 121 and the horizontal rod 123 are integrally connected to each other as an electric conductor, and a central portion between the vertical rod 121 and the horizontal rod 123 is bent.

The vertical rod 121 is disposed in a radial direction of the first conductor 110.

The vertical rod 121 penetrates the first conductor 110 in the radial direction. One end and the other end of the vertical rod 121 are disposed inside and outside the first conductor 110, respectively. The horizontal rod 123 to be described below is disposed at the end of the vertical rod 121 which is disposed inside the first conductor 110.

A part of the second conductor 120, which is exposed to the outside of the first conductor 110, is electrically connected to the transformer 143.

The horizontal rod 123 extends from the end of the vertical rod 121 in a direction parallel to a flow direction of a gas stream.

Here, the horizontal rod 123 is disposed at a central portion of the first conductor 110. The horizontal rod 123 may be disposed accurately at the central portion of the first conductor 110 in order to effectively remove the particulate matters.

The emitter 150 is provided at the end of the horizontal rod 123 and has multiple protrusions 150*a* formed on the outer surface of the emitter 150 and each having a cutting edge.

The emitter 150 is disposed in a direction identical to the direction in which the horizontal rod 123 is disposed. The emitter 150 may be disposed accurately at a center of the inside of the first conductor 110 in order to effectively remove the particulate matters.

Next, in the present exemplary embodiment, the insulator 130 is made of an electrically insulating material and provided to surround the vertical rod 121. Therefore, the vertical rod 121 and the first conductor 110 are not electrically connected to each other in the state in which the vertical rod 121 penetrates the first conductor 110.

Specifically, while one end of the insulator 130 is disposed inside the first conductor 110, the other end of the insulator 130 is disposed outside the first conductor 110, thereby electrically separating the second conductor 120 and the first conductor.

Meanwhile, a coupling groove 131, into which the horizontal rod 123 is fitted, may be formed at one end of the insulator 130, which is disposed inside the first conductor 110 so that the coupling state between the first conductor 110 and the second conductor 120 is maintained constantly.

Therefore, a bent portion of the second conductor 120, that is, a portion where the horizontal rod 123 and the vertical rod 121 meet together, is fitted and coupled into the coupling groove 131, such that a position of the second conductor 120 is not changed with respect to the insulator 130. Therefore, the second conductor 120 may be disposed at the central portion of the first conductor 110 in the direction parallel to the gas stream without a separate operation.

In addition, the coupling groove 131 may fix the insulator 130 and the second conductor 120 together with an anti-arcing member 160 to be described below, such that it is not necessary to interpose a separate bonding agent between the insulator 130 and the second conductor 120. Therefore, the assembly convenience is improved.

Next, the anti-arcing member 160 is made of a material having resistance to corrosion (erosion) caused by electric discharge. The anti-arcing member 160 is configured to cover one of the two ends of the insulator 130 which is disposed inside the first conductor 110.

In this case, the anti-arcing member 160 is joined to the horizontal rod 123.

Meanwhile, the anti-arcing member 160 and the insulator 130 are coupled to each other outside the first conductor 110 by means of a threaded member 170 and an electrode, the threaded member 170 is secured to an end of the second conductor 120, and the electrode is connected to the transformer 143. Therefore, no additional component is required to couple the anti-arcing member 160 and the insulator 130.

Meanwhile, in the present exemplary embodiment, the emitter 150 is positioned at a center inside the first conductor 110, and the horizontal rod 123 extends in a direction from the vertical rod 121 toward an upstream of the gas stream.

That is, the emitter 150 is disposed to face the gas stream.

In addition, in the present exemplary embodiment, the insulator 130 is shaped inside the first conductor 110 such that a horizontal cross-sectional area thereof is decreased in a direction from a wall surface of the first conductor 110 toward the horizontal rod 123.

In addition, in the present exemplary embodiment, negative power may be applied to the second conductor 120 in order to produce the non-thermal plasma (NTP).

Figure 4:
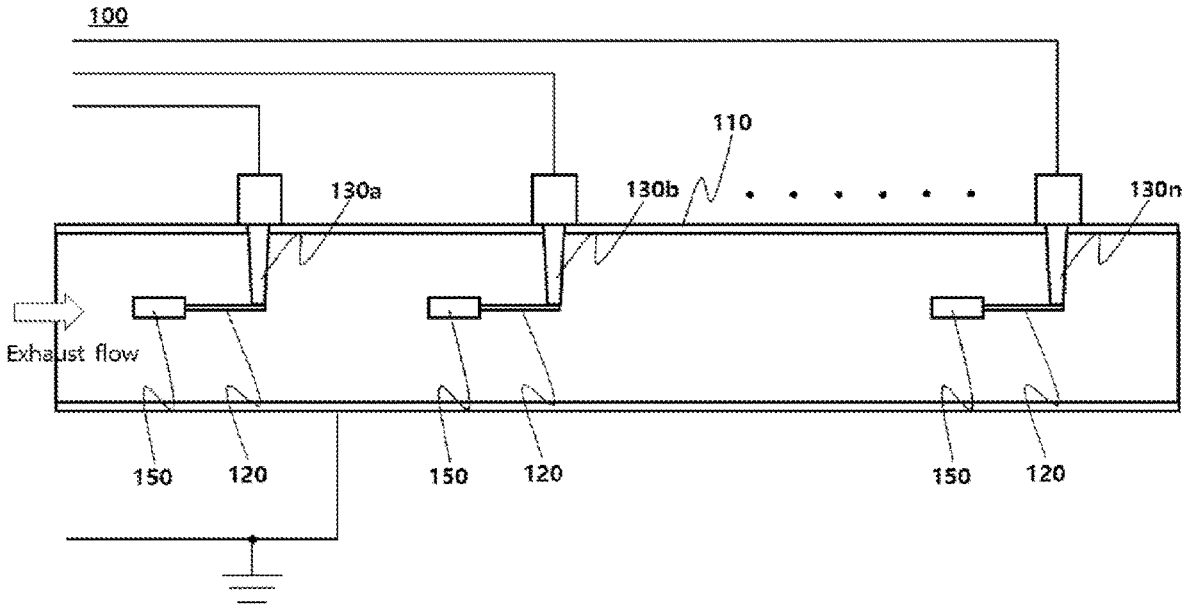
FIG. 4 is a view illustrating an example in which the system for reducing particulate matter in exhaust gas according to the present disclosure is installed.

FIG. 4 is a view illustrating an example in which the system for reducing particulate matter in exhaust gas according to the present disclosure is installed.

Referring to FIG. 4, the multiple systems 100 for reducing particulate matter in exhaust gas according to the present exemplary embodiment may be continuously disposed in series along a discharge path of the exhaust gas.

As a result, the efficiency in removing the particulate matters from the exhaust gas is of course improved.

What is claimed is:

1. A system for reducing particulate matter in an exhaust gas, the system comprising:

a first conductor provided in the form of a tubular body through which a gas stream flows and to which a ground power supply is connected;

a second conductor disposed in the first conductor and having an emitter which comes into contact with the gas stream and generates non-thermal plasma (NTP); and an insulator configured to electrically separate the second conductor from the first conductor, wherein a predetermined level of direct current voltage is continuously applied to the second conductor, wherein the second conductor includes:

a vertical rod disposed in a radial direction of the first conductor;

a horizontal rod extending from an end of the vertical rod in a direction parallel to a flow direction of the gas stream; and the emitter provided at an end of the horizontal rod and having multiple protrusions formed on an outer surface of the emitter and each having a cutting edge, wherein the insulator is made of an electrically insulating material and provided to surround the vertical rod, one end of the insulator is disposed inside the first conductor, the other end of the insulator is disposed outside the first conductor to electrically separate the second conductor and the first conductor, and a coupling groove, to which the horizontal rod is fitted, is provided at the end of the insulator, which is disposed in the first conductor, so that a coupled state between the first conductor and the second conductor remains constantly.

2. The system of claim 1, further comprising:

an anti-arcing member provided to cover one of the two ends of the insulator which is disposed inside the first conductor, wherein the anti-arcing member is joined to the horizontal rod and made of a material having resistance to corrosion (erosion) caused by electric discharge.

3. The system of claim 1, wherein the emitter is positioned at a center inside the first conductor, and the horizontal rod extends in a direction from the vertical rod toward an upstream of the gas stream.

4. The system of claim 1, wherein the insulator is shaped such that a horizontal cross-sectional area is decreased in the first conductor in a direction from a wall surface of the first conductor toward the horizontal rod.

5. The system of claim 1, wherein negative power is applied to the second conductor.

6. The system of claim 1, wherein the direct current voltage applied to the second conductor is −30 kV to −80 kV.

7. The system of claim 1, wherein multiple second conductors are disposed in a longitudinal direction of the first conductor, each electrically insulated from the first conductor, and each have an emitter configured to produce non-thermal plasma (NTP).

* * * * *